US011439219B2

(12) United States Patent
Guay et al.

(10) Patent No.: US 11,439,219 B2
(45) **Date of Patent: *Sep. 13, 2022**

(54) COSMETIC APPLICATOR ASSEMBLY

(71) Applicant: Noxell Corporation, Hunt Valley, MD (US)

(72) Inventors: Gordon Gerald Guay, Joppa, MD (US); Michael Christopher Sabino, Hunt Valley, MD (US)

(73) Assignee: NOXELL CORPORATION, Hunt Valley, MD (US)

( * ) Notice: Subject to any disclaimer, the term of this patent is extended or adjusted under 35 U.S.C. 154(b) by 420 days.

This patent is subject to a terminal disclaimer.

(21) Appl. No.: 16/474,917

(22) PCT Filed: Jan. 4, 2017

(86) PCT No.: PCT/US2017/012166

§ 371 (c)(1),
(2) Date: Jun. 28, 2019

(87) PCT Pub. No.: WO2018/128604

PCT Pub. Date: Jul. 12, 2018

(65) Prior Publication Data

US 2020/0178673 A1 Jun. 11, 2020

(51) Int. Cl.
*A46B 5/02* (2006.01)
*A45D 34/04* (2006.01)
(Continued)

(52) U.S. Cl.
CPC ..... *A45D 34/045* (2013.01); *A45D 40/265* (2013.01); *A46B 5/026* (2013.01);
(Continued)

(58) Field of Classification Search
CPC .. A45D 40/265; A45D 34/045; A45D 40/267; A45D 40/268; A45D 40/262;
(Continued)

(56) References Cited

U.S. PATENT DOCUMENTS 4,098,506 A * 7/1978 Gaiser ..... A63B 49/035 473/538
4,283,808 A * 8/1981 Beebe ..... A46B 5/02 15/145

(Continued)

FOREIGN PATENT DOCUMENTS

CN 101213054 A 7/2008
CN 107708481 A 2/2018

(Continued)

OTHER PUBLICATIONS

"International Application Serial No. PCT US2017 012166, International Preliminary Report on Patentability dated Jul. 18, 2019", 6 pgs.

(Continued)

*Primary Examiner* — David J Walczak
(74) *Attorney, Agent, or Firm* — Schwegman Lundberg & Woessner, P.A.

(57) ABSTRACT

A cosmetic applicator assembly includes a handle body having a proximal end, a distal end, a largest width or diameter of from 0.4 inches to 1.25 inches, and an exterior surface, an elevated feature disposed along the exterior surface and extending from 0.007 inches to 0.020 inches above the exterior surface, and a cosmetic applicator coupled to the distal end of the handle body and constructed to apply a cosmetic. The handle body includes a handle body material. The elevated feature include an elevated feature material, wherein the elevated feature material has a kinetic coefficient of friction of greater than or equal to 0.55 and a hardness of less than or equal to Shore A 70, and a hardness that is less than the hardness of the handle body material.

20 Claims, 10 Drawing Sheets

(51) Int. Cl.

| | |
|---|---|
| ***A45D 34/00*** | (2006.01) |
| ***A45D 40/26*** | (2006.01) |
| ***A45D 40/00*** | (2006.01) |

(52) U.S. Cl.

CPC ..... *A45D 2034/007* (2013.01); *A45D 2040/0012* (2013.01); *A46B 2200/1046* (2013.01); *A46B 2200/1053* (2013.01)

(58) Field of Classification Search

CPC .. A45D 34/042; A45D 34/043; A45D 34/046; A45D 34/047; A45D 2034/007; A45D 2040/0012; A46B 5/026; A46B 2200/1046; A46B 5/02; A46B 5/021; A46B 5/023; A46B 2200/1053; A46B 15/0087

USPC ..... 401/6, 126–130

See application file for complete search history.

(56) References Cited

U.S. PATENT DOCUMENTS

| | | | | |
|---|---|---|---|---|
| 5,077,857 | A | 1/1992 | Sellers | |
| 5,816,270 | A | 10/1998 | Nadel | |
| 5,926,901 | A * | 7/1999 | Tseng | B43K 23/004 15/167.1 |
| 6,298,516 | B1 | 10/2001 | Beals et al. | |
| 6,368,000 | B1 * | 4/2002 | Park | B43K 19/14 264/45.5 |
| 6,966,716 | B2 | 11/2005 | Pink | |
| 7,524,122 | B2 | 4/2009 | Pink | |
| 10,045,603 | B2 | 8/2018 | Guay et al. | |
| 2002/0039513 | A1 | 4/2002 | Pink | |
| 2002/0168214 | A1 | 11/2002 | Carullo et al. | |
| 2003/0170066 | A1 | 9/2003 | White | |
| 2004/0018241 | A1 | 9/2004 | Gueret | |
| 2004/0187885 | A1 | 9/2004 | Strong et al. | |
| 2004/0258457 | A1 | 12/2004 | Legendre | |
| 2009/0194126 | A1 | 8/2009 | Cassese | |
| 2010/0303532 | A1 | 12/2010 | Brunozzi | |
| 2011/0174328 | A1 | 7/2011 | Cerutti et al. | |
| 2012/0012131 | A1 | 1/2012 | Go et al. | |
| 2013/0111688 | A1 | 5/2013 | Lim | |
| 2014/0332028 | A1 | 11/2014 | Tran | |
| 2017/0000241 | A1 | 1/2017 | Guay et al. | |

FOREIGN PATENT DOCUMENTS

| | | | |
|---|---|---|---|
| KR | 20110008698 | U | 9/2011 |
| WO | WO-2017004344 | A1 | 1/2017 |
| WO | WO-2018128604 | A1 | 7/2018 |

OTHER PUBLICATIONS

"Chinese Application Serial No. 201680037287.2, Office Action dated Sep. 24, 2019", with English translation, 8 pages.
"European Application Serial No. 16738342.1, Communication Pursuant to Article 94(3) EPC dated Jan. 14, 2020", 6 pgs.
"Chinese Application Serial No. 201680037287.2, Office Action dated Mar. 9, 2020", with English translation, 15 pages.
"Chinese Application Serial No. 201680037287.2, Decision of Rejection dated Oct. 26, 2020", with English translation, 8 pages.
"European Application Serial No. 16738342.1, Summons to Attend Oral Proceedings mailed May 14, 2021", 7 pgs.
"U.S. Appl. No. 15/187,828, Non Final Office Action dated Sep. 7, 2017", 13 pgs.
"U.S. Appl. No. 15/187,828, Notice of Allowance dated Apr. 18, 2018", 7 pgs.
"U.S. Appl. No. 15/187,828, Response filed Feb. 7, 2018 to Non Final Office Action dated Sep. 7, 2017", 12 pgs.
"Chinese Application Serial No. 201680037287.2, Office Action dated Jan. 28, 2019", w/ English Translation, 13 pgs.
"Chinese Application Serial No. 201680037287.2, Response Filed Jun. 5, 2019 to Office Action dated Jan. 28, 2019", w/o English Claims, 5 pgs.
"European Application Serial No. 16738342.1, Response filed Jul. 18, 2018 to Communication pursuant to Rules 161(1) and 162 EPC dated Feb. 8, 2018", w/ English Claims, 17 pgs.
"International Application Serial No. PCT/US2016/040331, International Preliminary Report on Patentability dated Jan. 11, 2018", 8 pgs.
"International Application Serial No. PCT/US2016/040331, International Search Report dated Sep. 29, 2016", 3 pgs.
"International Application Serial No. PCT/US2016/040331, Written Opinion dated Sep. 29, 2016", 6 pgs.
"International Application Serial No. PCT/US2017/012166, International Search Report dated Mar. 13, 2017", 2 pgs.
"International Application Serial No. PCT/US2017/012166, Written Opinion dated Mar. 13, 2017", 4 pgs.
U.S. Appl. No. 15/187,828 U.S. Pat. No. 10,045,603, filed Jun. 21, 2016, Cosmetic Applicator Assembly.
"Mexican Application Serial No. MX/a/2017/016245, Office Action dated Aug. 16, 2021", with machine English translation, 6 pages.
"Chinese Application Serial No. 201680037287.2, Notice of Reexamination dated Mar. 17, 2022", wi English translation, 12 pgs.

* cited by examiner

COSMETIC APPLICATOR ASSEMBLY

CROSS-REFERENCE TO RELATED APPLICATION

This application is a U.S. National Stage Filing under 35 U.S.C. 371 from International Application No PCT/US2017/012166, filed on Jan. 4, 2017, and published as W( ) 2018/128604 on Jul. 12, 2018, which application is incorporated herein by reference in its entirety.

BACKGROUND

The cosmetic industry is continually releasing a variety of new and improved cosmetic products to provide the consumer a variety of functional and technical benefits. As such, there is a need for improved cosmetic applicators.

SUMMARY

In one embodiment, a cosmetic applicator assembly includes a handle body having a proximal end, a distal end, a largest width or diameter of from 0.4 inches to 1.25 inches, and an exterior surface, an elevated feature disposed along the exterior surface and extending from 0.007 inches to 0.020 inches above the exterior surface, and a cosmetic applicator coupled to the distal end of the handle body and constructed to apply a cosmetic. The handle body includes a handle body material. The elevated feature include an elevated feature material, wherein the elevated feature material has a kinetic coefficient of friction of greater than or equal to 0.55 and a hardness of less than or equal to Shore A 70, and a hardness that is less than the hardness of the handle body material.

In another embodiment, a cosmetic applicator assembly includes a handle body comprising a proximal end, a distal end, a largest width or diameter of from 0.4 inches to 1.25 inches, and an exterior surface, an elevated feature disposed along the exterior surface and extending from 0.007 inches to 0.015 inches above the exterior surface, and a cosmetic applicator coupled to the distal end of the handle body and constructed to apply a cosmetic. The handle body includes a handle body material. The elevated feature includes an elevated feature material, wherein the elevated feature material has a kinetic coefficient of friction of less than or equal to 0.55 and a hardness of greater than or equal to Shore A 70.

DESCRIPTION OF DRAWINGS

FIG. 3 is a partial cross sectional view of a handle body 12 of the cosmetic applicator assembly of FIG. 1;

DETAILED DESCRIPTION

Figure 1:
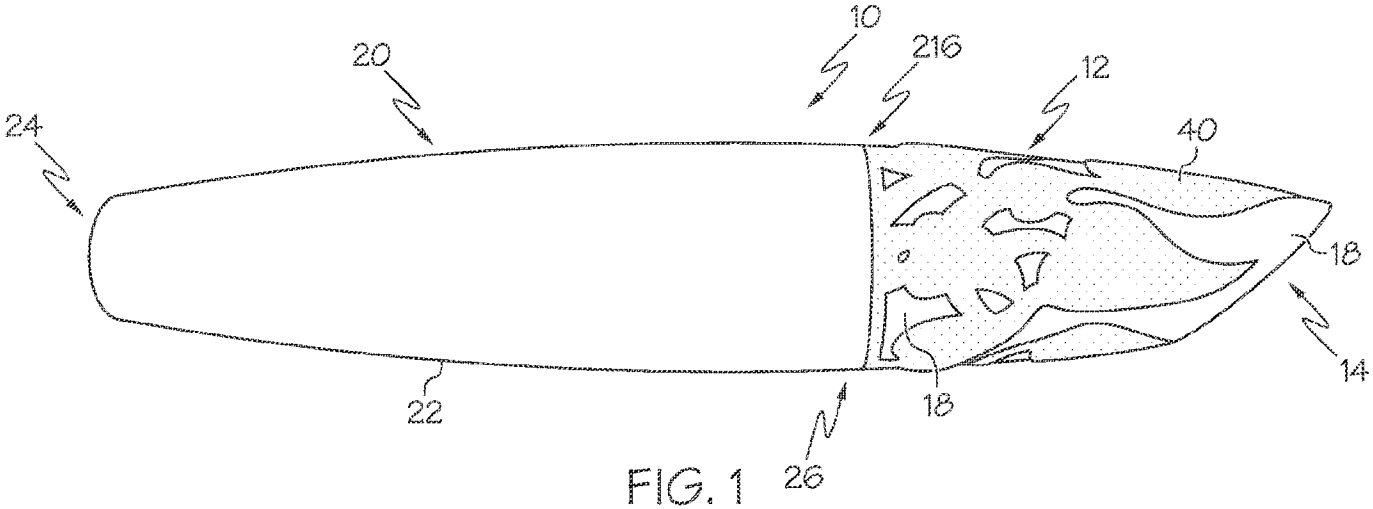
FIG. 1 is a side elevational view of an embodiment of a cosmetic applicator assembly according to one or more embodiments.

The following text sets forth a broad description of numerous different embodiments. The description is to be construed as exemplary only and does not describe every possible embodiment since describing every possible embodiment would be impractical, if not impossible, and it will be understood that any feature, characteristic, component, composition, ingredient, product, step or methodology described herein can be deleted, combined with or substituted for, in whole or part, any other feature, characteristic, component, composition, ingredient, product, step or methodology described herein. Numerous alternative embodiments could be implemented, using either current technology or technology developed after the filing date of this patent, which would still fall within the scope of the claims.

It should also be understood that, unless a term is expressly defined in this specification using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). No term is intended to be essential unless so stated. To the extent that any term recited in the claims at the end of this patent is referred to in this patent in a manner consistent with a single meaning, that is done for sake of clarity only so as to not confuse the reader, and it is not intended that such a claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

Method of Measuring a Kinetic Coefficient of Friction of a Material:

A kinetic coefficient of friction was measured for a variety of materials disclosed herein. The method to measure the kinetic coefficient of friction for each material included using a KES-SE friction tester manufactured by KES KATO TECH CO having a KES SE silicone probe (23.2 grams). The probe is caused to engage and/or slip across a solid substrate materials to determine the kinetic coefficient of friction of the material. The measurements were determined on a dry substrate (material) under a controlled temperature and humidity environment of 70° F. degrees at 40% relative humidity using a KES SE silicone probe (23.2 grams) on solid substrate materials. The testing speed for the silicone probe was conducted at 1 mm/sec. Machine Integrated Units (MIU)=Digital output from KES SE Machine for a given surface. The kinetic coefficient of friction was calculated as (Coefficient of MIU)*(MIU)=Kinetic Coefficient of Friction. The Coefficient of MIU for each surface tested which is calculated as follows:

Coefficient of MIU=5×SENS×SPEED/LOAD;

SENS=1 at High sensitivity;

SPEED=Sled speed; and

LOAD=23.2 grams.

In our tests disclosed herein, SENS equaled 1, SPEED equaled 1 mm/sec, and LOAD equaled 23.2 grams. All of the measurements of the kinetic coefficient of friction of the materials herein were averages of at least three measurements and were determined using the above methodology.

Kinetic Coefficient of Friction=Sample MIU*Coefficient of MIU.

Method of Measuring Shore A, Shore D, and Shore 00 of A Material:

Shore A hardness measurements were measured for a variety of materials disclosed herein. The method to measure Shore A hardness for several materials disclosed herein included using a Model X-A (Asker Instruments). Similarly, Shore D hardness measurements were measured for a variety of materials disclosed herein. The method to measure Shore D hardness included using a Model X-D (Asker Instruments). Finally, Shore 00 hardness measurements were measured for a variety of materials disclosed herein. The method to measure Shore 00 hardness for several materials disclosed herein included using Model X-C (Asker Instruments). The method used to measure Shore A, Shore D, and Shore 00 is well known in the art and thus no additional detail is required. All Shore A, D, OO values disclosed herein are averages from at least three separate measurements using the test method as described above herein.

Figure 2:
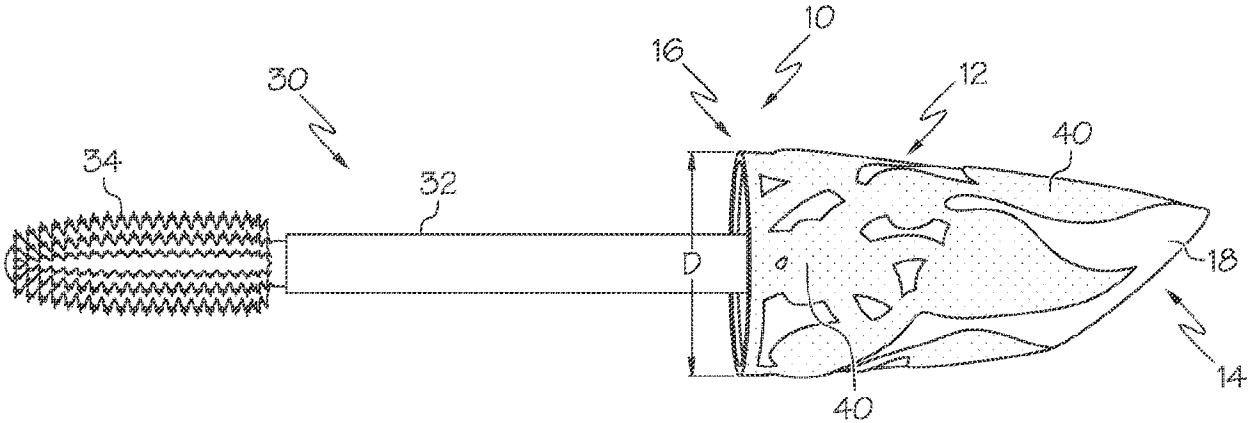
FIG. 2 is a side elevational view of the cosmetic applicator assembly of FIG. 1, wherein a cover has been removed from the assembly.

One or more embodiments of a cosmetic applicator assembly shown and described herein may generally include a handle body, an elevated feature extending from the handle body, and a cosmetic applicator coupled to the handle body. Referring to FIGS. 1-3, an embodiment of a cosmetic applicator assembly shown as 10. The cosmetic applicator assembly 10, in some embodiments, may include a handle body 12 and a cover 20 attached thereto. Referring specifically to FIG. 1, the cover 20 includes a cover body 22 with a closed end 24, an open end 26 opposite the closed end, and a reservoir (not shown) disposed within the cover body 22 and in communication with the open end. The cover 20 and/or the handle body 12 may include threading, snap-fit, detents, and other conventional mechanisms to couple the cover 20 and the handle body 12 together.

Referring specifically to FIG. 2, the handle body 12 includes a proximal end 14, a distal end 16 opposite the proximal end, and an exterior surface 18. Additionally, the handle body 12 includes an elevated feature 40 disposed along the handle body that forms a pattern. The handle body 12 includes a cosmetic applicator 30 coupled to its distal end 16. The handle body 12 may have a width (W) or diameter (D) depending upon the cross-sectional shape of the handle body. In some embodiments, the largest width (W) or largest diameter (D) is less than or equal to 1.25 inches. In some embodiments, the largest width or largest diameter is from 0.4 inches to 1.25 inches.

In this embodiment, the handle body 12 has a substantially cigar-shaped profile. However, it is understood that the handle body 12 and/or the cover 20 may have a variety of shapes, sizes, and configurations. In some embodiments, the handle body can have a radial cross sectional shape that includes, but is not limited to, circular-shaped, oval-shaped, triangular-shaped, quadrilateral shaped, pentagonal-shaped, hexagonal-shaped, heptagonal-shaped, octagonal-shaped, nonagonal-shaped, decagonal-shaped, combinations thereof, or the like. Moreover, in some embodiments, the handle body may have a longitudinal cross sectional shape that includes, but is not limited to, linear-shaped, nonlinear-shaped, cigar-shaped, quadrilateral-shaped, oval-shaped, combinations thereof, or the like.

The handle body 12 may be fabricated from a variety of handle body materials such as, for example, plastics, metals, composites, and combinations thereof. In some embodiments, the handle body material may include, but not be limited to, polypropylene (PP), high density polyethylene (HDPE), low density polyethylene (LDPE), polymethylmethacrylate (PMMA), acrylonitrile butadiene styrene (ABS), styrene acrylonitrile (SAN) and polyethylene terephthalate (PET).

As shown in FIG. 2, in this embodiment, the cosmetic applicator 30 further includes a stem 32 coupled to the distal end 16 of the handle body 12 and a tip 34 coupled to a distal end of the stem 32. In some embodiments, the stem 32 may have a length from 0.5 inches to 5.0 inches. In some embodiments, the tip 34 may include, but not be limited to a brush, comb, felt, foam, flocked surfaces, other conventional or yet-to-be developed applicators constructed to apply cosmetics, or combinations thereof. The tip 34 is constructed and designed to apply a cosmetic to a person such as, for example, to apply a mascara to eyelashes, lip gloss to lips, lip liner to the outer edge of lips, or the like.

The stem 32 and tip 34 may be moved toward the open end 26 of the cover body 22 such that the stem 32 and 34 are inserted into the open end 26 and ultimately into the reservoir (not shown) of the cover 20. In some embodiments, the cover 20 may contain and/or store a cosmetic within the reservoir. In such an embodiment, the tip 34 engages and/or is inserted into the cosmetic when disposed within the reservoir such that when the stem 32 and tip 34 are removed from the reservoir, the tip 34 contains a portion of the cosmetic thereon for application onto an object such as, for example, a eyelashes, lips, eyelids, etc. In this embodiment, the tip 34 is a brush for applying an eyelash cosmetic.

The elevated feature 40 extends radially outward away from the exterior surface 18. FIG. 3 illustrates a cross sectional view of the handle body 12 with the cosmetic tip and stem removed for illustrative purposes only. In some embodiments, the height (H) of the elevated feature 40 is less than or equal to 0.020 inches above the exterior surface 18 as illustrated, for example, in FIG. 3. In some embodiments, the height (H) of the elevated feature 40 is from about 0.007 inches to about 0.020 inches above the exterior surface 18.

The elevated feature 40 may comprise any number, shape, size, pattern, and configuration and be disposed anywhere along the exterior surface 18 of the handle body 12. In the embodiment shown in FIGS. 1-2, the elevated feature 40 may form an ivy pattern or vines and leaves, and in some embodiments, this pattern can be considered a gripping zone. The elevated feature 40 of FIGS. 1-2 has a ratio (density) of 62%. The ratio (density) is a measurement of the area of the exterior surface covered by the elevated feature to the total area of the exterior surface.

Figure 5:
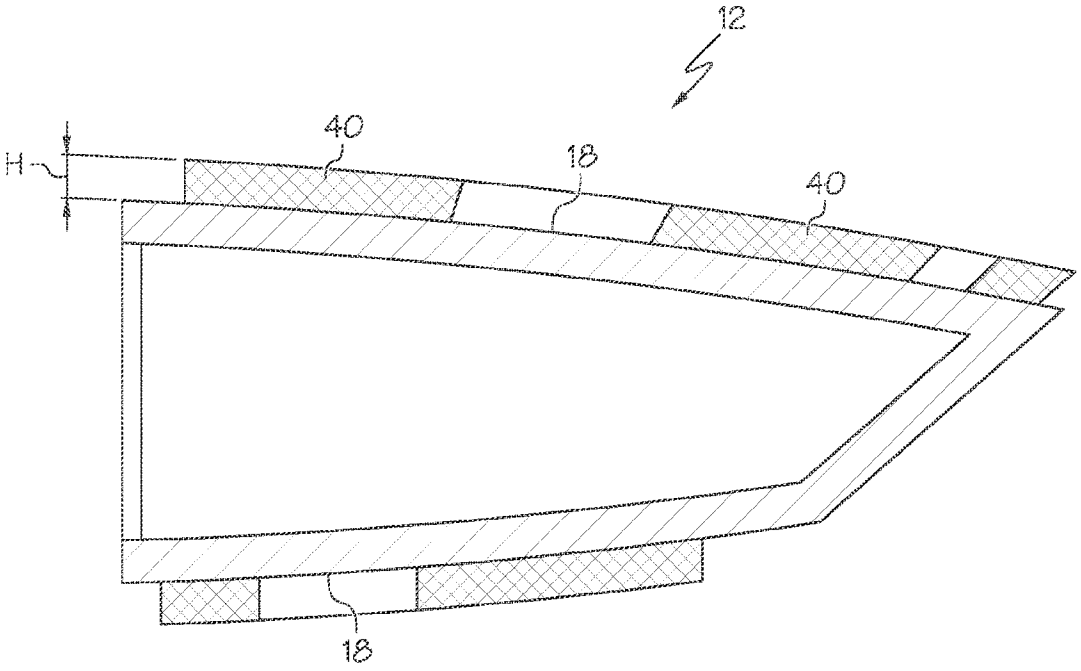
FIG. 5 is a side elevational view of another embodiment of a handle body 12 of the cosmetic applicator assembly of FIG. 1.
Figure 4:
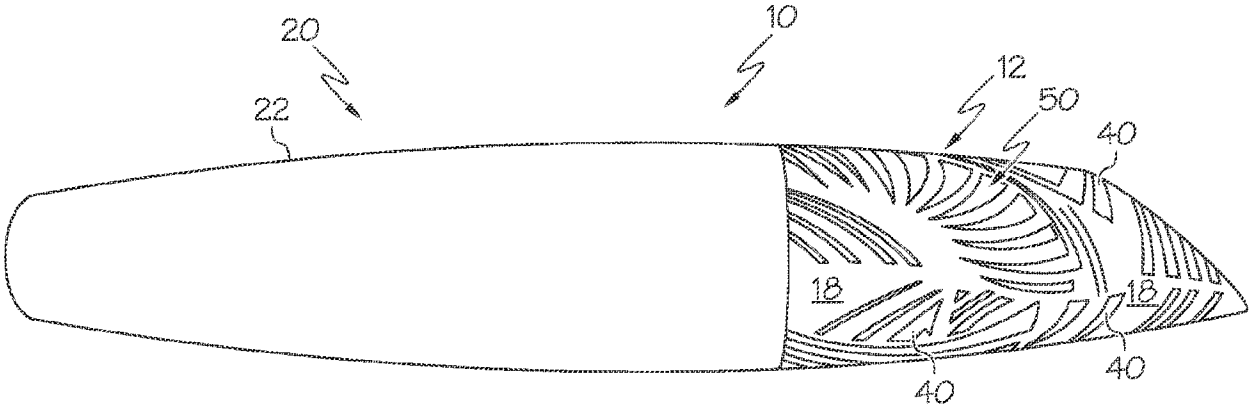
FIG. 4 is a side elevational view of another embodiment of a handle body of the cosmetic applicator assembly of FIG. 1.
Figure 5:
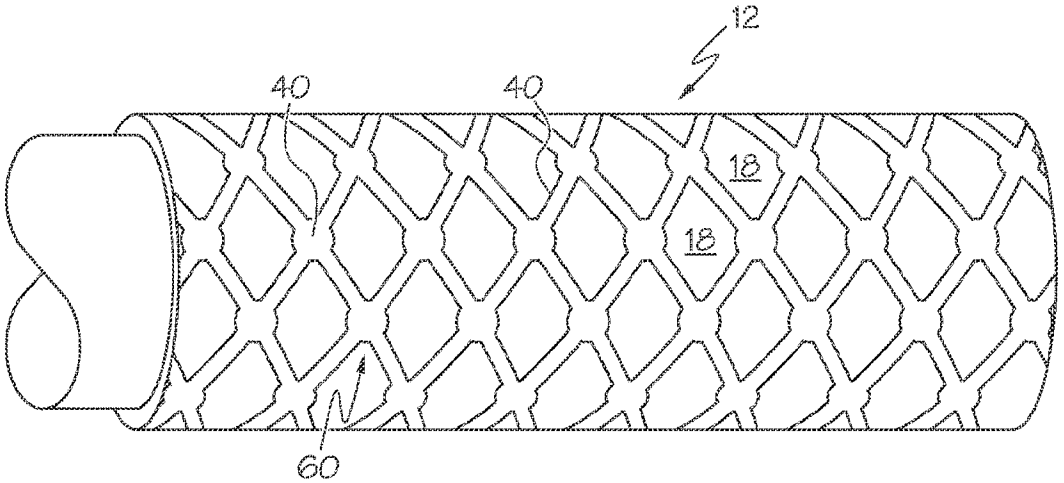
Figure 6C:
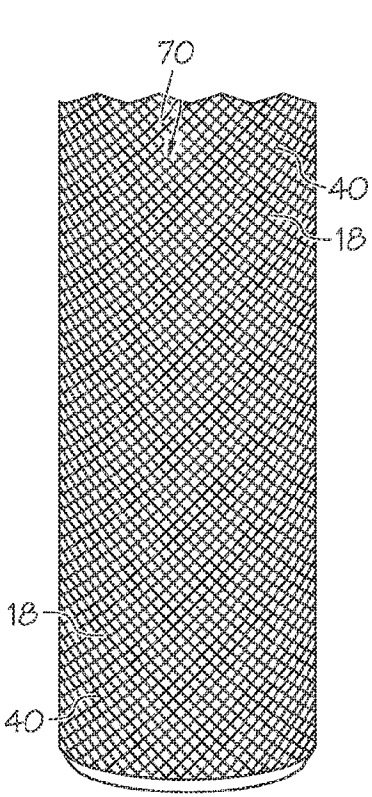
FIG. 6C is a partial side elevational view of another embodiment of a handle body of the cosmetic applicator assembly of FIG. 1.
Figure 6B:
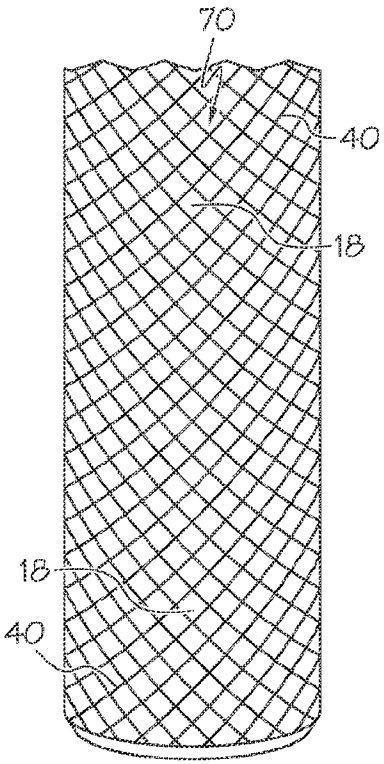
FIG. 6B is a partial side elevational view of another embodiment of a handle body of the cosmetic applicator assembly of FIG. 1.
Figure 6A:
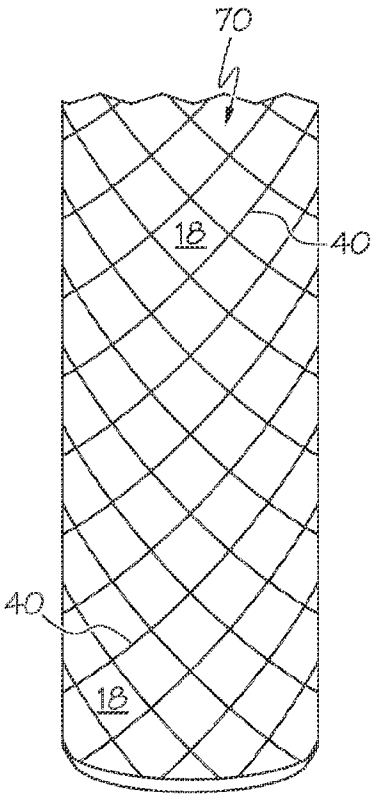
FIG. 6A is a partial side elevational view of another embodiment of a handle body of the cosmetic applicator assembly of FIG. 1.
Figure 7C:
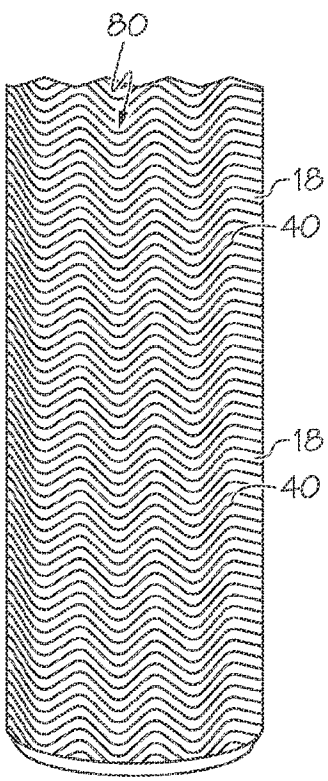
FIG. 7C is a partial side elevational view of another embodiment of a handle body of the cosmetic applicator assembly of FIG. 1.
Figure 7B:
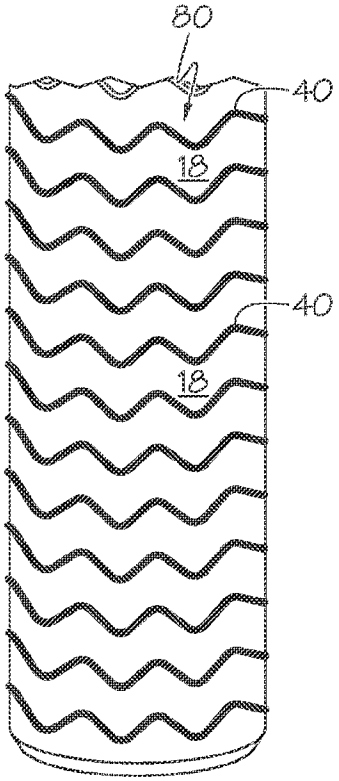
FIG. 7B is a partial side elevational view of another embodiment of a handle body of the cosmetic applicator assembly of FIG. 1.
Figure 7A:
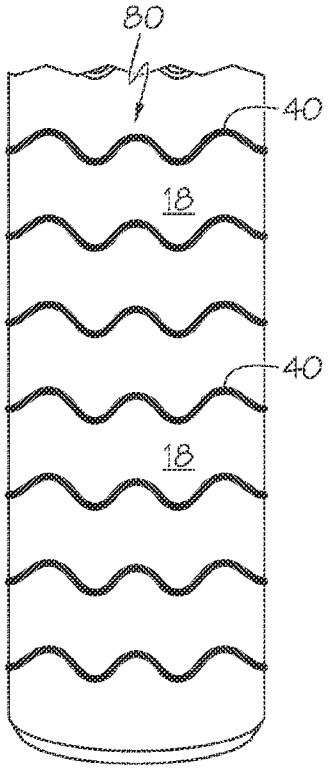
FIG. 7A is a partial side elevational view of another embodiment of a handle body of the cosmetic applicator assembly of FIG. 1.
Figure 8C:
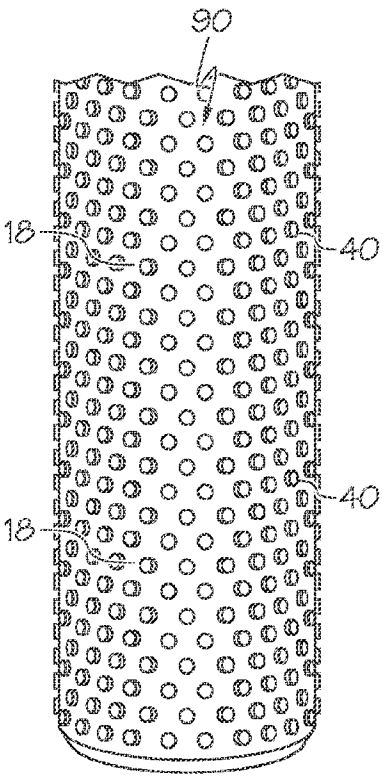
FIG. 8C is a partial side elevational view of another embodiment of a handle body of the cosmetic applicator assembly of FIG. 1.
Figure 8B:
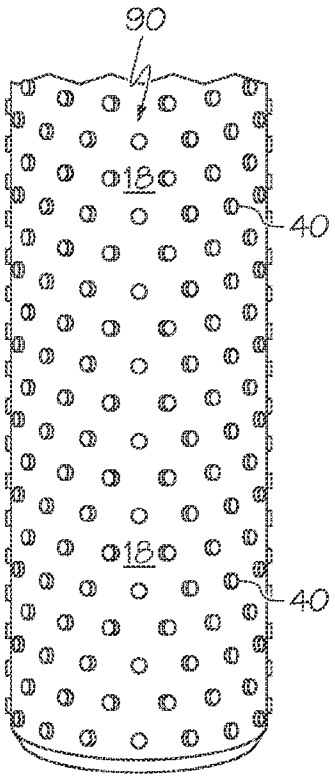
FIG. 8B is a partial side elevational view of another embodiment of a handle body of the cosmetic applicator assembly of FIG. 1.
Figure 8A:
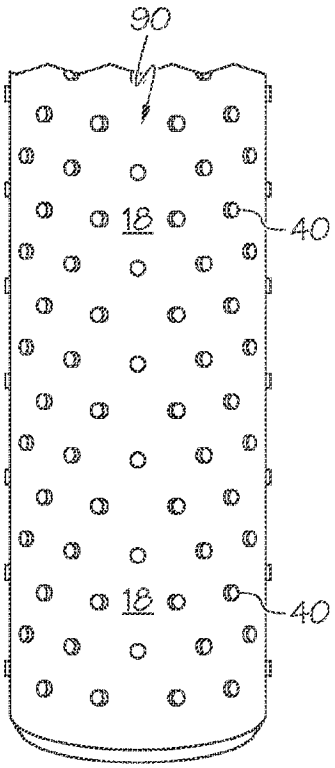
FIG. 8A is a partial side elevational view of another embodiment of a handle body of the cosmetic applicator assembly of FIG. 1.

In some embodiments, the elevated feature 40 includes a plurality of features 40 that form a fern pattern 50 such as shown, for example, in FIG. 4. In some embodiments, the elevated feature 40 forms a fish-net stocking pattern 60 as shown, for example, in FIG. 5. In some embodiments, the elevated feature 40 forms a cross-hatched pattern 70 as shown, for example, in FIGS. 6*a*-6*c*. In some embodiments, the elevated feature 40 forms a wavy pattern 80 as shown, for example, in FIGS. 7*a*-7*c*. In some embodiments, the elevated feature 40 includes a plurality of elevated features 40 that form a raised dot pattern 90 as shown, for example, in FIGS. 8*a*-8*c*. Referring to FIGS. 6*a*-6*c*, each figure shows essentially the same cross-hatched pattern, but the density of that pattern across the exterior surface of the handle body progressively increases from FIG. 6*a*-6*c*, i.e., the ratio of the area of the exterior surface covered by the elevated feature to the area of the total exterior surface progressively increases. Referring to FIGS. 7*a*-7*c*, each figure shows essentially the same wavy pattern, but the density of that pattern across the exterior surface of the handle body progressively increases from FIG. 7*a*-7*c*, i.e., the ratio of the area of the exterior surface covered by the elevated feature to the area of the total exterior surface progressively increases. Referring to FIGS. 8*a*-8*c*, each figure shows essentially the same cross-hatched pattern, but the density of that pattern across the exterior surface of the handle body progressively increases from FIG. 8*a*-8*c*, i.e., the ratio of the area of the exterior surface covered by the elevated features to the area of the total exterior surface progressively increases.

In some embodiments, the pattern of the elevated feature or features can be configured to provide, convey or signal a product benefit, quality or capability to a consumer. For example, an elevated feature(s) configured to form a curly pattern may convey that the functional and/or technical benefit of the product is to provide a curl to a user's body part such as, for example, to eye lashes. In another example, an elevated feature(s) are configured to form a volume pattern such as, for example, the pattern shown in FIG. 4, which conveys that the functional and/or technical benefit of the product is to provide volume to eye lashes. In another example, an elevated feature(s) configured to form a series of lines which may conveys that the functional and/or technical benefit of the product is to provide volume to eye lashes. In another example, an elevated feature(s) are configured to form a volume pattern such as, for example, the pattern shown in FIG. 5, which conveys that the functional and/or technical benefit of the product is to provide a user a seductive look. Other patterns that may be used include, but are not limited to the infinity sign to signal or convey long wear, cross-hatching to signal or convey precision, or a rain drop or other water pattern to signal or convey moisturization benefits of the product.

Referring back to FIGS. 1-3, the elevated feature 40 is disposed along the exterior surface from the proximal end 14 to the distal end 16, covering a portion of the exterior surface 18. In some embodiments, the elevated feature(s) 40 may cover a substantial portion of the exterior surface 18. In some embodiments, the elevated feature(s) 40 may cover the entire exterior surface 18, except the exterior surface at the proximal end 14. In some embodiments, the elevated feature(s) 40 may cover the entire surface 18 including the exterior surface at the proximal end 14. In some embodiments, a single, integral component or a plurality of components may form the elevated feature 40.

In some embodiments, the elevated feature 40 may be disposed at a position on the handle body 12 at least adjacent to the distal end 16 of the handle body 12. In some embodiments, the elevated feature 40 traverses from a position adjacent to the distal end to a distance of less than or equal to 50% of the total length of the handle body. In some embodiments, the elevated feature traverses from a position adjacent to the distal end to a distance of less than or equal to 30% of the total length of the handle body. In some embodiments, the elevated feature 40 may be disposed at a position on the handle body 12 at least adjacent to the proximal end 14.

Figure 9:
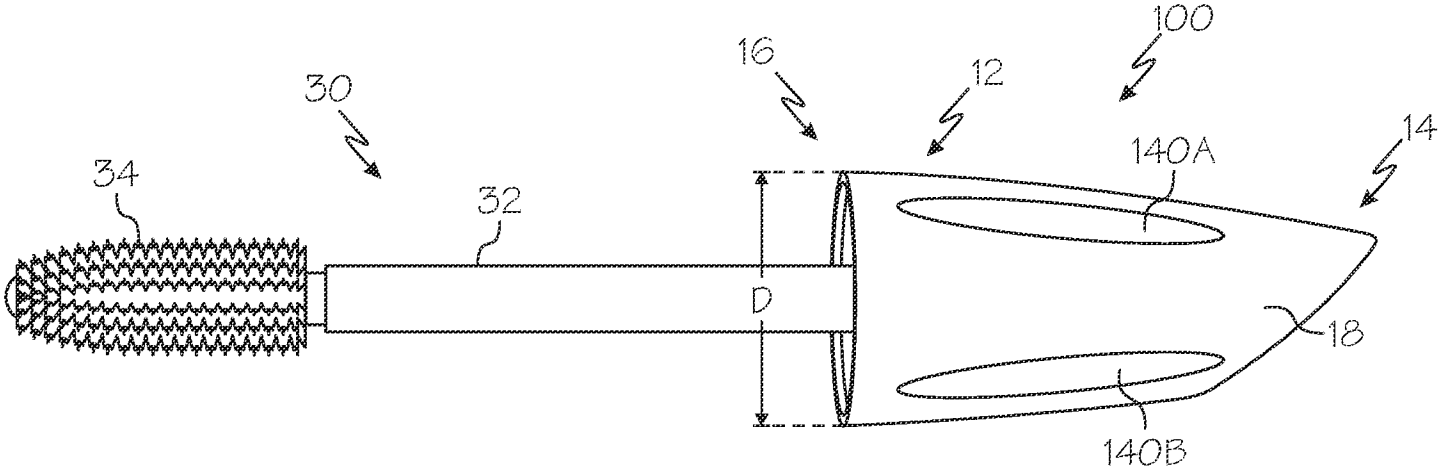
FIG. 9 is a side elevational view of the cosmetic applicator assembly of FIG. 1, including another embodiment of the handle body and wherein the cover has been removed from the assembly.

Referring to FIG. 9, another embodiment of a cosmetic applicator assembly 100 is shown. This embodiment may include all or some of the components, features, shapes, and/or sizes of and fabricated using the same or different materials as the embodiment described above and shown in FIGS. 1-8. Like components are labeled the same. Similar to assembly 10, the handle body 12 of assembly 100 may have a width (W) or diameter (D) depending upon the cross-sectional shape of the handle body. In some embodiments, the largest width (W) or largest diameter is less than or equal to 1.25 inches. In some embodiments, the largest width or largest diameter is from 0.4 inches to 1.25 inches.

In the embodiment shown, the cosmetic applicator assembly 100 includes all of the same features as the cosmetic applicator assembly 10 (e.g., FIGS. 1 and 2), except for the configuration of the elevated feature(s). In this embodiment, the cosmetic applicator assembly 100 includes a first elevated feature 140*a*, a second elevated feature 140*b*, a third elevated feature (not shown), and a fourth elevated feature (not shown) that are separate and discrete from each other and are spaced-apart from each other about the circumference of the handle body 12. In such a configuration, the exterior surface 18 is exposed between the elevated surfaces 140*a*-140*d*. One or more of the elevated features may form one or more gripping zones about the circumference of the handle body 12 for receiving one or more phalanxes of one or more fingers of a user's hand. In this embodiment, the first through fourth features 140*a*-140*d* are elongated and substantially oval-shaped.

As shown, the elevated features 140*a*-140*d* are disposed along the exterior surface from substantially adjacent to the proximal end 14 to substantially adjacent to the distal end 16, covering a portion of the exterior surface 18. In some embodiments, the elevated features 140*a*-140*d* may cover more or less of the exterior surface than as shown in this embodiment. However, similar to the embodiment described above with reference to FIGS. 1-3, the plurality of elevated features 140*a*-140*d* of assembly 100 may comprise any number, shape, size, pattern, and configuration and be disposed anywhere along the exterior surface 18 of the handle body 12. The elevated features 140*a*-140*d* may also be disposed at any number of positions along and configured to cover any portion of the exterior surface of the handle body 12.

In some embodiments, the height (H) of one or more of the elevated features 140*a*-140*d* is less than or equal to 0.020 inches above the exterior surface 18 as illustrated, for example, in FIG. 3. In some embodiments, the height (H) of one or more of the elevated features 140*a*-140*d* is from about 0.007 inches to about 0.020 inches above the exterior surface 18.

Figure 10:
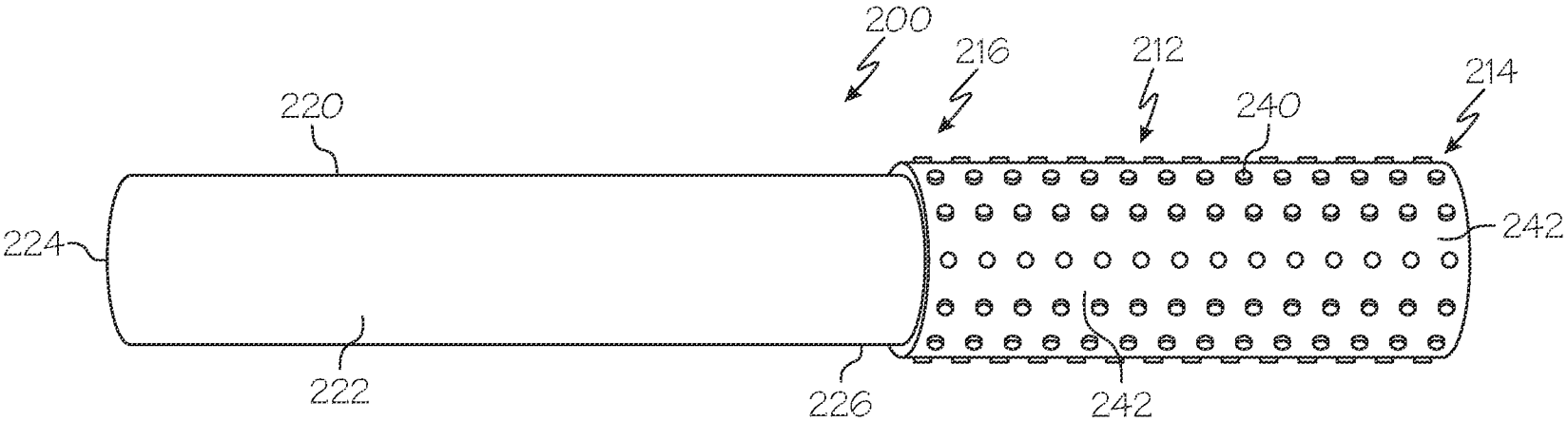
FIG. 10 is a side elevational view of another embodiment of a cosmetic applicator assembly according to one or more embodiments.
Figure 11A:
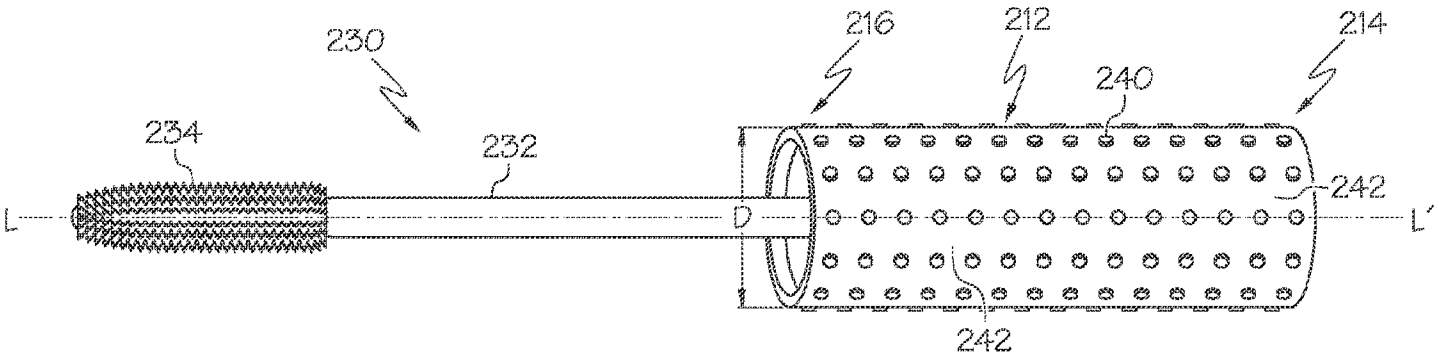
FIG. 11A is a side elevational view of another embodiment of a cosmetic applicator assembly according to one or more embodiments.
Figure 11B:
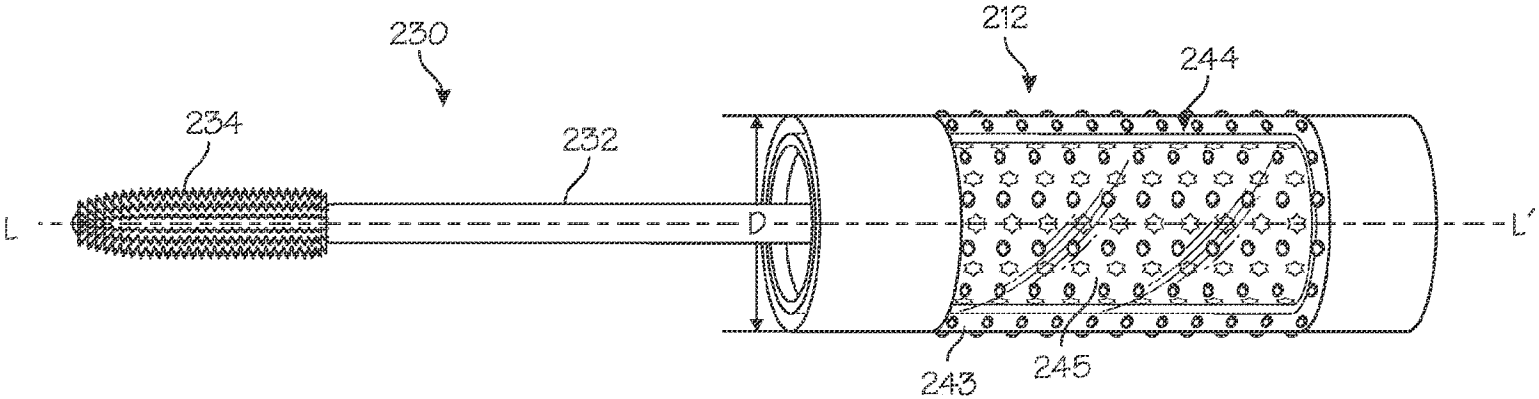
FIG. 11B is a side elevational view of another embodiment of a cosmetic applicator assembly according to one or more embodiments.

Referring to FIGS. 10-11B, another embodiment of a cosmetic applicator assembly is shown as assembly 200. This embodiment may include all or some of the components, features, shapes, and/or sizes of and fabricated using the same or different materials as the embodiment described above and shown in FIGS. 1-9. Like components are labeled the same. The cosmetic applicator assembly 200, in some embodiments, may include a handle body 212 and a cover 220 attached thereto. Referring specifically to FIG. 10, the cover 220 includes a cover body 222 with a closed end 224, an open end 226 opposite the closed end, and a reservoir (not shown) disposed within the cover body 222 and in communication with the open end. The cover 220 and/or the handle body 212 may include threading, snap-fit, detents, and other conventional mechanisms to couple the cover 220 and the handle body 212 together.

Referring specifically to FIGS. 11A-B, the handle body 212 includes a proximal end 214, a distal end 216 opposite the proximal end, and an exterior surface (not shown). Additionally, the handle body 212 includes a plurality of elevated features 240 disposed along the handle body 212, and a cosmetic applicator 230 coupled to the distal end 216 of the handle body 212. The handle body 212 may have a width (W) or diameter (D) depending upon the cross-sectional shape of the handle body. In some embodiments, the largest width (W) or largest diameter (D) is less than or equal to 1.25 inches. In some embodiments, the largest width or largest diameter is from 0.4 inches to 1.25 inches. In this embodiment, the handle body 212 and the cover 220 have a substantially cylindrical-shaped profile. However, it is understood that the handle body 212 and/or the cover 220 may have a variety of shapes, sizes, and configurations.

The handle body 212 may be fabricated from a variety of handle body materials such as, for example, plastics, metals, composites, and combinations thereof. In some embodiments, the handle body material may include, but not be limited to, polypropylene (PP), high density polyethylene (HDPE), low density polyethylene (LDPE), polymethymethacrylate (PMMA), acrylonitrile butadiene styrene (ABS), styrene acrylonitrile (SAN) and polyethylene terephthalate (PET).

As shown in FIGS. 11A-B, in this embodiment, the cosmetic applicator 230 further includes a stem 232 coupled to the distal end 216 of the handle body 212 and a tip 234 coupled to a distal end of the stem 232. The stem and tip 232 and 234, respectively, may be the same as, similar to, or different from the stem and tip of assembly 10 above herein. The stem 232 and tip 234 may be moved toward the open end 226 of the cover body 222 such that the stem 232 and 234 are inserted into the open end 226 and ultimately into the reservoir (not shown) of the cover 220. In some embodiments, the cover 220 may contain and/or store a cosmetic within the reservoir. In such an embodiment, the tip 234 engages and/or is inserted into the cosmetic when disposed within the reservoir such that when the stem 232 and tip 234 are removed from the reservoir, the tip 234 contains a portion of the cosmetic thereon for application onto an object such as, for example, a eyelashes, lips, eyelids, etc. In this embodiment, the tip 234 is a brush for applying an eyelash cosmetic.

In this embodiment, the plurality of elevated features 240 comprises discrete protrusions extending from a base layer 242. The base layer 242 covers a portion or the entire exterior surface of the handle body 212. In some embodiments, the elevated features 240 and base layer 242 are fabricated from the same material. In other embodiments, the elevated features 240 and base layer 242 are fabricated from different materials. In some embodiments, the handle body does not include a base layer. In some embodiments, the base layer 242 and the plurality of elevated features 240 form one or more gripping zones to receive one or more phalanxes of one or more fingers of a user's hand. The elevated features 240 extend radially outward from the base layer 242, and thus, ultimately, radially away from the exterior surface of the handle body 212. The elevated features 240 are shown disposed in longitudinal rows that are aligned with a longitudinal axis L-L' of the handle body 212. However, it is understood that such elevated features 240 may be disposed in a variety of patterns and configurations or disposed uniformly and/or randomly about the handle body. Also, the elevated feature or features 240 may comprise a variety of shapes, sizes, and heights such as, for example, the patterns shown in FIGS. 2, 4, 5, 6*a*-6*c*, and 7*a*-7*c*. In some embodiments, the height (H) of one or more of the plurality of elevated features 240 is less than or equal to 0.020 inches above the exterior surface 18 as illustrated, for example, in FIG. 3. In some embodiments, the height (H) of one or more of the elevated features 240 is from about 0.007 inches to about 0.020 inches above the exterior surface 18.

Referring specifically to FIG. 11B, the base layer 242 can comprise a sleeve 243 mateable with the handle body 212. Here, at least a portion of the length of the handle body 212 comprises a receiving portion 244 that has a width or diameter than is less than the largest width or diameter of the handle body 212. The sleeve 243 can be mateable with the receiving portion 244 of the handle body 212 and can have a minimum thickness that is the difference between the largest width or diameter and the reduced width or diameter of the handle body. In some embodiments, the sleeve 243 can be translucent. The sleeve 243 can comprise a material having an optical transmittance of at least 65% and, more preferably, at least 71%. A decorative layer 245 can be disposed between the handle body 212 and the sleeve 243. The decorative layer 245 can be formed a number of ways including, for example and without limitation, hot stamping, 3-D printing, silk screening, via adhesive stock, and the like.

As shown, the plurality of elevated features 240 and the base layer 242 are disposed along the exterior surface from the proximal end 214 to the distal end 16, covering the entire exterior surface. In some embodiments, the elevated features 240 and base layer 242 may be positioned at a minimum adjacent to the distal end 216, thus, at a minimum, only covering a portion of the handle body 212. In some embodiments, the elevated features 240 and base layer 242 may be positioned at a minimum adjacent to the proximal end 214 of the handle body 212, thus, at a minimum, only covering a portion of the handle body 212. Similar to the plurality of elevated features 40 set forth above herein, the elevated features 240 and base layer 242 may traverse from a position adjacent to the distal end 216 to a distance of less than or equal to 50% of the total length of the handle body, or in some embodiments, to a distance of less than or equal to 30% of the total length of the handle body.

Figure 12:
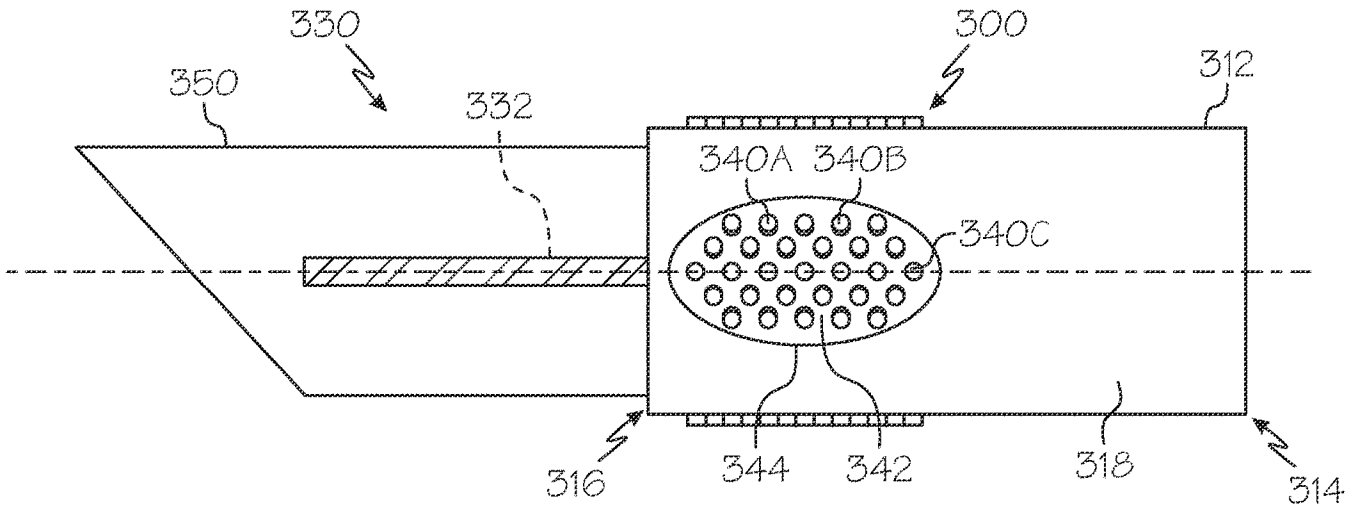
FIG. 12 is a side elevational view of another embodiment of a cosmetic applicator assembly according to one or more embodiments.
Figure 13:
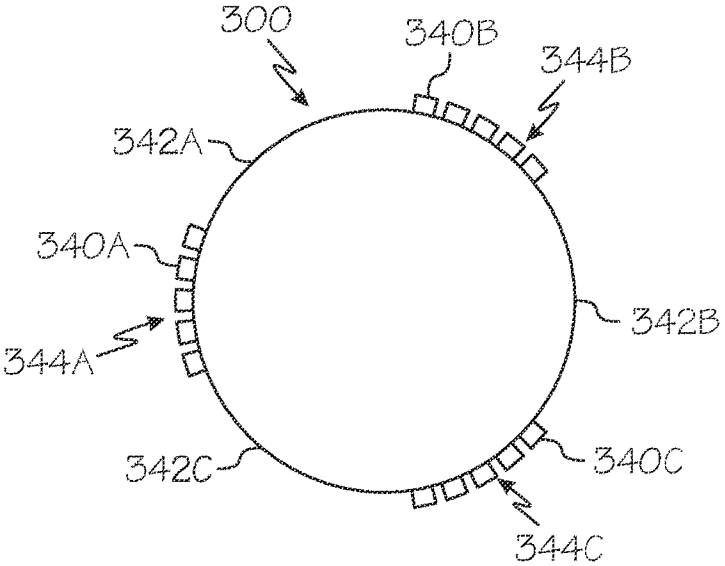
FIG. 13 is a schematic end view of the cosmetic applicator assembly of FIG. 12 with the cosmetic and cosmetic applicator removed.
Figure 14:
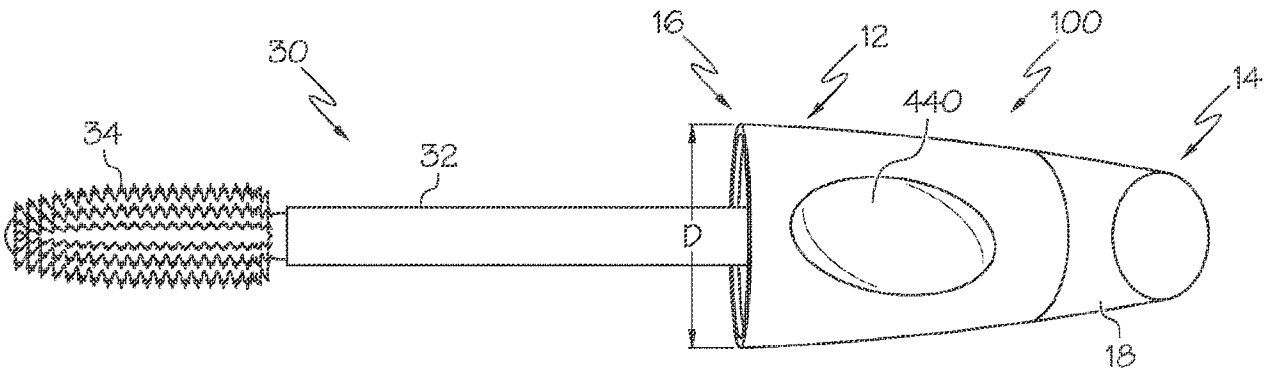
FIG. 14 is a side elevational view of another embodiment of a cosmetic applicator assembly according to one or more embodiments.

Referring FIGS. 12-13, a cosmetic applicator assembly 300 is shown. This embodiment may include all or some of the components, features, shapes, and/or sizes of and fabricated using the same or different materials as the embodiments described above and shown in FIGS. 1-11. Like components are labeled the same. The cosmetic applicator assembly 300 includes a handle body 312 having a proximal end 314, a distal end 316 opposite the proximal end, and an exterior surface 318. The assembly 300 also includes a cosmetic applicator 330 coupled to the distal end 316 of the handle body 312. The cosmetic applicator 330 includes a stem 332 configured to hold and apply a cosmetic 350 such as, for example, mascara or lip gloss. The embodiment shown in FIGS. 12-13 is a lip gloss applicator assembly.

As shown, the handle body 312 includes a plurality of elevated features 340 that extend radially outward away from the exterior surface 318. In this embodiment, the elevated features 340 form three separate and discrete gripping zones 344*a*, 344*b*, and 344*c* that each comprise a plurality of elevated features 340*a*, 340*b*, and 340*c*, respectively, disposed within the respective gripping zone. In some embodiments, a base layer 342*a*, 342*b*, and 342*c* is positioned between the plurality of elevated features 340*a*, 340*b*, and 340*c* and covers the exterior surface 318 within the respective gripping zones 344*a*, 344*b*, and 344*c*. In some embodiments, the base layer is fabricated from the same material as the plurality of elevated features. In some embodiments, the base layer is fabricated from a different material. In some embodiments, the gripping zones do not include a base layer disposed between the respective elevated features. Instead, the spaces between the elevated features include just the exposed exterior surface 318.

The gripping zones 344*a*, 344*b*, and 344*c* may be disposed anywhere along the exterior surface 318. However, in the embodiment shown, the three gripping zones are disposed approximately an equal distance about the circumference of the handle body 312 about the longitudinal axis L-L'. As such, the gripping zones are substantially 120 degrees apart. In addition, in this embodiment, the gripping zones are disposed at a position along the handle body 312 adjacent to the distal end 316. In this embodiment, each of the gripping zones is constructed to have a shape and size that approximates the shape and size of a first phalanx of a finger of a user's hand to permit each gripping zone to receive one or more phalanxes of a respective finger. In some embodiments, a fourth gripping zone with a respective plurality of elevated features extending therefrom may be included along the handle body 312. In such an embodiment, the other three gripping zones may be repositioned to provide spacing for the fourth gripping zone. The spacing between the gripping zones in any of the embodiments does not have to be equidistant.

It is understood that any number of gripping zones may be included along the handle body 312 besides the several examples set forth herein. For example, in some embodiments, the handle body 312 may only include a single gripping zone with its plurality of elevated features. In some embodiments, the handle body 312 may only include two gripping zones, each with their plurality of elevated features.

In one or more of the embodiments set forth above, including the embodiment shown in FIGS. 1-14, the elevated feature(s) such as, for example, elevated feature(s) 40, 140, 240, 340*a*-340*c*, and/or base layer such as, for example, base layers 242, 342*a*-342*c*, may be provided to the end user as adhesive appliques or laminates (referred to generally as "adhesive substrates") which can be applied to the handle body by the end user wherever they feel it would be beneficial to, for example and without limitation, improve handling of the cosmetic applicator assembly and the like. The adhesive substrates can comprise pre-defined or pre-set patterns or configurations of either single or plural appliques. Additionally or alternatively, the adhesive appliques or laminates can comprise user-defined or user-set patterns or configurations of either single or plural appliques. In some embodiments, an adhesive substrate can be sized and shaped to encircle at least a portion of the exterior surface of the handle body. The adhesive substrates can be produced using, for example and without limitation, UV curable inks to produce elevated feature(s) and base layer(s) as described herein, including the embodiments shown in FIGS. 1-14.

In one or more of the embodiments set forth above, including the embodiment shown in FIGS. 1-14, the elevated feature(s) such as, for example, elevated feature(s) 40, 140, 240, 340*a*-340*c*, and/or base layer such as, for example, base layers 242, 342*a*-342*c*, may be fabricated from a material that has a kinetic coefficient of friction of greater than or equal to 0.55 and a hardness of less than or equal to Shore A 70. In some embodiments, the elevated feature(s) such as, for example, elevated feature(s) 40, 140, 240, 340*a*-340*c*, and/or base layer such as, for example, base layers 242, 342*a*-342*c*, may be fabricated from a material that has a kinetic coefficient of friction from 0.55 to 1.9 and a hardness from Shore 00 30 to Shore A 70.

In one or more of the embodiments set forth above, including the embodiment shown in FIGS. 1-14, the elevated feature(s) such as, for example, elevated feature(s) 40, 140, 240, 340*a*-340*c*, and/or base layer such as, for example, base layers 242, 342*a*-342*c*, may be fabricated from a material that has a kinetic coefficient of friction from about 2.0 to about 6.0 and a hardness of less than or equal to Shore A 70. In some embodiments, the elevated feature(s) such as, for example, elevated feature(s) 40, 140, 240, 340*a*-340*c*, and/or base layer such as, for example, base layers 242, 342*a*-342*c*, may be fabricated from a material that has a hardness that is less than the hardness of the handle body material. In some embodiments, the elevated feature(s) such as, for example, elevated feature(s) 40, 140, 240, 340*a*-340*c*, and/or base layer such as, for example, base layers 242, 342*a*-342*c*, may be fabricated from a material that has a kinetic coefficient of friction from about 3.5 to about 6.0 and, additionally or alternatively, a hardness from about Shore A 40 to about Shore A 60. In some embodiments, the surface of the exterior surface covered by the elevated feature(s) 40, 140, 240, 340*a*-340*c*, and/or base layer such as, for example, base layers 242, 342*a*-342*c*, may have a surface roughness from 0.370 to about 0.580. The surface roughness can be determined in either $R_a$ or $S_a$ values using optical profilometry.

In some embodiments, the elevated feature(s) such as, for example, elevated feature(s) 40, 140, 240, 340*a*-340*c*, and/or base layer such as, for example, base layers 242, 342*a*-342*c*, may be fabricated from a material such as, for example, thermoplastic elastomers, silicon rubber, thermoplastic rubber, thermoplastic olefins, combinations thereof, or the like. In some embodiments, the elevated feature(s) such as, for example, elevated feature(s) 40, 140, 240, 340*a*-340*c*, and/or base layer such as, for example, base layers 242, 342*a*-342*c*, may be fabricated from a material selected from a group consisting of thermoplastic elastomers, silicon rubber, thermoplastic rubber, thermoplastic olefins, and combinations thereof.

In one or more of the embodiments set forth above, including the embodiment shown in FIGS. 1-14, the hardness of the elevated feature material is less than the hardness of the handle body material. In one or more of the embodiments set forth above, including the embodiment shown in FIGS. 1-14, the kinetic coefficient of friction of the elevated feature material is higher than the kinetic coefficient of friction of the handle body material. In one or more of the embodiments set forth above, including the embodiment shown in FIGS. 1-14, both, the hardness of the elevated feature material is less than the hardness of the handle body material and the kinetic coefficient of friction of the elevated feature material is higher than the kinetic coefficient of friction of the handle body material. It is also understood that, in some embodiments, the kinetic coefficient of friction and hardness of the elevated feature material and/or base layer material may be the same as or greater than the handle body material.

In an example, the elevated feature or elevated features such as, for example, feature(s) such as, for example, elevated feature(s) 40, 140, 240, 340*a*-340*c*, may have a height (H) of 0.007 inches to 0.020 inches above the exterior surface such as, for example surface 18 and 318. In addition, elevated feature(s) such as, for example, elevated feature(s) 40, 140, 240, 340*a*-340*c*, and/or base layer such as, for example, base layers 242, 342*a*-342*c*, are fabricated from a material having a kinetic coefficient of friction that is greater than or equal to 0.55 and a hardness of less than or equal to Shore A 70. In some embodiments, the elevated feature(s) such as, for example, elevated feature(s) 40, 140, 240, 340*a*-340*c*, and/or base layer such as, for example, base layers 242, 342*a*-342*c*, may be fabricated from a material that has a kinetic coefficient of friction from 0.55 to 1.9 and a hardness from Shore 00 30 to Shore A 70.

In one or more of the embodiments set forth above, including the embodiment shown in FIGS. 1-14, the elevated feature(s) such as, for example, elevated feature(s) 40, 140, 240, 340*a*-340*c*, and/or base layer such as, for example, base layers 242, 342*a*-342*c*, may be fabricated from a material that has a kinetic coefficient of friction of less than or equal to 0.55 and a hardness of greater than or equal to Shore A 70. In some embodiments, elevated feature(s) such as, for example, elevated feature(s) 40, 140, 240, 340*a*-340*c*, and/or base layer such as, for example, base layers 242, 342*a*-342*c*, may be fabricated from a material that has a kinetic coefficient of friction from 0.2 to 0.55 and a hardness from Shore A 70 to Shore D 80.

It is also understood that, in one or more of the embodiments set forth above, including the embodiment shown in FIGS. 1-14, the kinetic coefficient of friction and hardness of the elevated feature material and/or base layer material may be less than, same as, or greater than the handle body material, depending upon the desired texture, design and comfort.

In some embodiments, the elevated feature(s) such as, for example, elevated feature(s) 40, 140, 240, 340*a*-340*c*, and/or base layer such as, for example, base layers 242, 342, may be fabricated from a material such as, for example, polypropylene (PP), high density polyethylene (HDPE), low density polyethylene (LDPE), polymethymethacrylate (PMMA), Acrylonitrile Butadiene Styrene (ABS), styrene acrylonitrile (SAN), polyethylene terephthalate (PET), combinations thereof, or the like. In some embodiments, the elevated features 40, 140, 240, 340 and/or base layer such as, for example, base layers 242, 342, may be fabricated from a material selected from the group consisting of polypropylene (PP), high density polyethylene (HDPE), low density polyethylene (LDPE), polymethymethacrylate (PMMA), Acrylonitrile Butadiene Styrene (ABS), styrene acrylonitrile (SAN), polyethylene terephthalate (PET), and combinations thereof.

In an example, the elevated feature or elevated features such as, for example, feature(s) such as, for example, elevated feature(s) 40, 140, 240, 340*a*-340*c*, may have a height (H) of 0.007 inches to 0.015 inches above the exterior surface such as, for example surface 18 and 318. In addition, the elevated feature(s) such as, for example, elevated feature(s) 40, 140, 240, 340*a*-340*c*, and/or base layer such as, for example, base layers 242, 342*a*-342*c*, are fabricated from a material having a kinetic coefficient of friction that is less than or equal to 0.55 and a hardness of greater than or equal to Shore A 70. In some embodiments, the elevated feature(s) such as, for example, elevated feature(s) 40, 140, 240, 340*a*-340*c*, and/or base layer such as, for example, base layers 242, 342*a*-342*c*, may be fabricated from a material that has a kinetic coefficient of friction from 0.2 to 0.55 and a hardness from Shore A 70 to Shore D 80.

In one or more embodiments set forth above, including the assemblies shown in FIGS. 1-14, the handle body may include one or more elevated features (e.g., 40, 140, 240, 340, 440.) that in total comprise an area that covers at least (or at a minimum) 1.15 square inches or more of the area (e.g., surface area) of the exterior surface (e.g., 18, 218, 318) In one or more embodiments set forth above, including the assemblies shown in FIGS. 1-14, the handle body (e g., 12, 212, and 312) may include one or more gripping zones such as, for example, gripping zones 344 α-344 *c*, wherein one or more of the gripping zones may have a minimum area of greater than or equal to 1.15 square inches. In other words, the area of one or more of the gripping zones may cover at least (at a minimum) 1.15 square inches of the exterior surface of the handle body. In some embodiments, such minimum area provides a gripping zone that is sized to approximate and received a distal phalanx of a finger for a user. In some embodiments, a three finger engagement of a handle body is contemplated. In one exemplary embodiment, the first phalanx of each of three fingers can engage a handle body. For a 0.65" handle body, from about 3.0 $cm^2$ to about 3.2 $cm^2$ coverage can be desirable.

In one or more embodiments set forth above, including the assemblies shown in FIGS. 1-14, the handle body (e.g., 12, 212, and 312) may include an elevated feature density from 10% to 93%. As set forth above, the density of elevated feature or elevated features is calculated using the ratio of the area of the exterior surface that the elevated feature or elevated features cover to the total surface area of the exterior surface of the handle body. In some embodiments, the density of the elevated features across the handle body is from 15% to 85%. In some embodiments, the plurality of elevated features form a dot pattern (e.g., FIGS. 8, 10, 11, 12, 13) across the handle body and the density of the elevated features equals from 13% to 40%. In some embodiments, the plurality of elevated features forms a wavy pattern (e.g., FIGS. 7*a*-7*c*) across the handle body and the density of the elevated features equals from 10% to 33%. In some embodiments, the plurality of elevated features form a cross-hatched pattern (e.g., FIGS. 6*a*-6*c*) across the handle body and the density of the elevated features equals from 30% to 93%.

Figure 15:
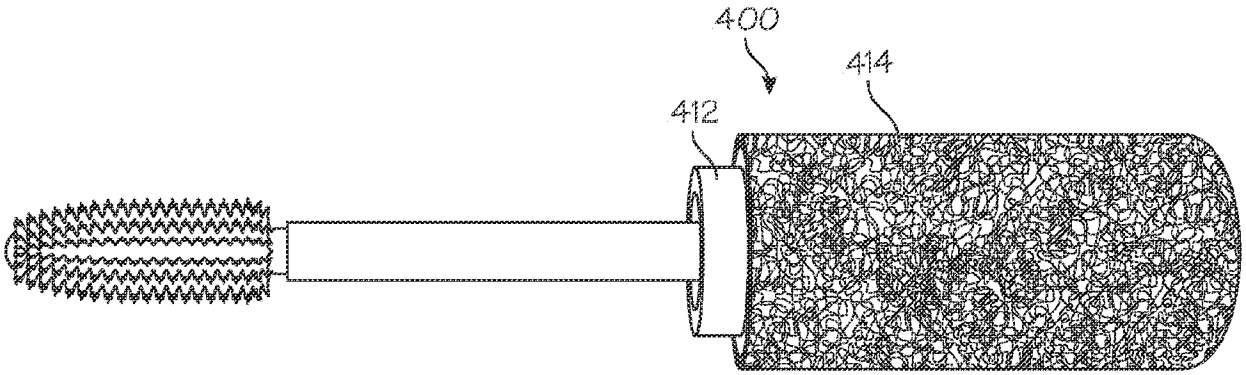
FIG. 15 is a perspective view of another embodiment of a cosmetic applicator assembly according to one or more embodiments.

In another embodiment illustrated in FIG. 15, a cosmetic applicator assembly 400 can comprise a handle body 412. Both the cosmetic applicator assembly 400 and the handle body 412 are substantially as described above according to the embodiments of FIGS. 1-14 except for any differences noted herein. The cosmetic applicator assembly 400 can further comprise a sleeve 414 disposed along at least a portion of an exterior surface of the handle body. The sleeve 414 can comprise a foam material. The foam material can comprise, for example and without limitation, polyurethane (PU), hydrophilic polyurethane, polyester, and combinations thereof. The foam material can comprise at least one of a shape memory foam and a closed cell foam. The foam material can have a porosity of from about 60 to about 115 pores per square inch (ppi), and in particular, about 60 ppi, about 80 ppi, about 100 ppi, and about 115 ppi. The sleeve 414 can have an outer diameter or width of from about 0.9 to about 2.0 inches. The sleeve 414 can have one closed end and one open end or two open ends. The sleeve 414 can be provided separately and applied to a handle body 412 by an end user or can be provided attached to the handle body 412.

A LIST OF NUMBERED EXAMPLES FOLLOW

Example 1 is a cosmetic applicator assembly, comprising: a handle body comprising a proximal end, a distal end, a largest width or diameter of from 0.4 inches to 1.25 inches, and an exterior surface extending from the proximal end to the distal end, wherein the handle body comprises a handle body material; an elevated feature disposed along at least a portion of the exterior surface and extending from 0.007 inches to 0.020 inches above the exterior surface, wherein: the elevated feature comprises an elevated feature material, the elevated feature material has a kinetic coefficient of friction of from 2.0 to 6.0 and a hardness of less than or equal to Shore A 70, and the elevated feature material has a hardness that is less than the hardness of the handle body material; and a cosmetic applicator coupled to the distal end of the handle body.

In Example 2, the subject matter of Example 1 optionally includes wherein the kinetic coefficient of friction of the elevated feature material is from 3.5 to 6.0 and the hardness of the elevated feature material is from Shore A 40 to Shore A 60.

In Example 3, the subject matter of any one or more of Examples 1-2 optionally includes a ratio of the surface area of the exterior surface covered by the elevated feature to the total surface area of the exterior surface that ranges from 10% to 93%.

In Example 4, the subject matter of any one or more of Examples 1-3 optionally includes wherein the elevated feature comprises a plurality of the elevated features spaced apart from each other along the exterior surface.

In Example 5, the subject matter of Example 4 optionally includes wherein the surface of the exterior surface covered by the elevated feature has a surface roughness from 0.370 to about 0.580.

In Example 6, the subject matter of any one or more of Examples 4-5 optionally includes wherein the plurality of elevated features forms a dot pattern and the ratio is from 13% to 40%.

In Example 7, the subject matter of any one or more of Examples 4-6 optionally includes wherein the plurality of elevated features forms a wavy pattern and the ratio is from 10% to 33%.

In Example 8, the subject matter of any one or more of Examples 4-7 optionally includes wherein the plurality of elevated features forms a cross-hatched pattern and the ratio is from 30% to 93%.

In Example 9, the subject matter of any one or more of Examples 4-8 optionally includes wherein the plurality of elevated features form a plurality of gripping zones, each one of the plurality of gripping zones comprising a portion of the plurality of elevated features and having a minimum area of 1.15 square inches.

In Example 10, the subject matter of Example 9 optionally includes wherein the plurality of gripping zones comprises three gripping zones.

In Example 11, the subject matter of Example 10 optionally includes wherein the three gripping zones are disposed about the handle body substantially equidistant from each other.

In Example 12, the subject matter of any one or more of Examples 9-11 optionally include wherein each one of the plurality of gripping zones is not integral with another one of the plurality of gripping zones.

In Example 13, the subject matter of any one or more of Examples 1-12 optionally include wherein a radial cross sectional shape of the handle body is selected from the group consisting of circular-shaped, oval-shaped, triangular-shaped, quadrilateral-shaped, pentagonal-shaped, hexagonal-shaped, heptagonal-shaped, octagonal-shaped, nonagonal-shaped, decagonal-shaped, and combinations thereof.

In Example 14, the subject matter of any one or more of Examples 1-13 optionally include wherein a longitudinal cross sectional shape of the handle body is selected from the group consisting of linear-shaped, nonlinear-shaped, cigar-shaped, quadrilateral-shaped, oval-shaped, and combinations thereof.

In Example 15, the subject matter of any one or more of Examples 1-14 optionally include wherein the cosmetic applicator comprises a stem coupled to the distal end of the handle body and a tip coupled to a distal end of the stem, and wherein the tip is selected from the group consisting of a brush, comb, felt, foam, flocked surfaces, and combinations thereof.

In Example 16, the subject matter of any one or more of Examples 1-15 optionally include wherein the elevated feature material is a material selected from a group consisting of thermoplastic elastomers, silicon rubber, thermoplastic rubber, thermoplastic olefins, and combinations thereof.

Example 17 is a cosmetic applicator assembly, the applicator assembly comprising: a handle body comprising a proximal end, a distal end, a largest width or diameter of from 0.4 inches to 1.25 inches, and an exterior surface, wherein the handle body is comprised of a handle body material; a sleeve disposed along at least a portion of the exterior surface, the sleeve comprising a foam material; and a cosmetic applicator coupled to the distal end of the handle body and constructed to apply a cosmetic.

In Example 18, the subject matter of Example 17 optionally includes wherein the foam material comprises polyurethane (PU), hydrophilic polyurethane, polyester, and combinations thereof.

In Example 19, the subject matter of Example 18 optionally includes wherein the foam material has from about 60 to about 115 pores per square inch.

In Example 20, the subject matter of any one or more of Examples 17-19 optionally include wherein the foam material comprises at least one of a shape memory foam and a closed cell foam.

In Example 21, the subject matter of any one or more of Examples 17-20 optionally includes wherein the sleeve has an outer diameter of from about 0.9 inches to about 2.0 inches.

Example 22 is a cosmetic applicator system, comprising: a cosmetic applicator, comprising: a handle body comprising a proximal end, a distal end, a largest width or diameter of from 0.4 inches to 1.25 inches, and an exterior surface extending from the proximal end to the distal end, wherein the handle body comprises a handle body material; a cosmetic applicator coupled to the distal end of the handle body; and a substrate having an elevated feature disposed along at least a portion of a functional surface and an adhesive surface opposite the functional surface, wherein the elevated feature extends from 0.007 inches to 0.020 inches above the functional surface, wherein: the elevated feature comprises an elevated feature material, the elevated feature material has a kinetic coefficient of friction of from 2.0 to 6.0 and a hardness of less than or equal to Shore A 70, and the elevated feature material has a hardness that is less than the hardness of the handle body material; wherein the substrate is selectively adhereable to the exterior surface of the handle body.

In Example 23, the subject matter of Example 22 optionally includes wherein the substrate comprises a plurality of substrates.

In Example 24, the subject matter of any one or more of Examples 22-23 optionally include wherein the substrate is sized and shaped to encircle at least a portion of the exterior surface of the handle body.

In Example 25, the subject matter of any one or more of Examples 22-24 optionally include wherein the elevated feature material comprises UV-curable ink.

In Example 26, the subject matter of any one or more of Examples 22-25 optionally include wherein the kinetic coefficient of friction of the elevated feature material is from 3.5 to 6.0 and the hardness of the elevated feature material is from Shore A 40 to Shore A 60.

In Example 27, the subject matter of any one or more of Examples 22-26 optionally include a ratio of the surface area of the functional surface covered by the elevated feature to the total surface area of the functional surface that ranges from 10% to 93%.

In Example 28, the subject matter of Example 27 optionally includes wherein the elevated feature comprises a plurality of elevated features spaced apart from each other along the functional surface.

In Example 29, the subject matter of Example 28 optionally includes wherein sleeve has a surface roughness from 0.370 to about 0.580.

In Example 30, the subject matter of any one or more of Examples 28-29 optionally include wherein the plurality of elevated features forms a dot pattern and the ratio is from 13% to 40%.

In Example 31, the subject matter of any one or more of Examples 28-30 optionally include wherein the plurality of elevated features forms a wavy pattern and the ratio is from 10% to 33%.

In Example 32, the subject matter of any one or more of Examples 28-31 optionally include wherein the plurality of elevated features forms a cross-hatched pattern and the ratio is from 30% to 93%.

In Example 33, the subject matter of any one or more of Examples 28-32 optionally include wherein the plurality of elevated features form a plurality of gripping zones, each one of the plurality of gripping zones comprising a portion of the plurality of elevated features and having a minimum area of 1.15 square inches.

In Example 34, the subject matter of Example 33 optionally includes wherein the plurality of gripping zones comprises three gripping zones.

In Example 35, the subject matter of Example 34 optionally includes wherein the three gripping zones are disposed across the functional surface substantially equidistant from each other.

In Example 36, the subject matter of any one or more of Examples 33-35 optionally include wherein each one of the plurality of gripping zones is not integral with another one of the plurality of gripping zones.

In Example 37, the subject matter of any one or more of Examples 22-36 optionally include wherein a radial cross sectional shape of the handle body is selected from the group consisting of circular-shaped, oval-shaped, triangular-shaped, quadrilateral-shaped, pentagonal-shaped, hexagonal-shaped, heptagonal-shaped, octagonal-shaped, nonagonal-shaped, decagonal-shaped, and combinations thereof.

In Example 38, the subject matter of any one or more of Examples 22-37 optionally include wherein a longitudinal cross sectional shape of the handle body is selected from the group consisting of linear-shaped, nonlinear-shaped, cigar-shaped, quadrilateral-shaped, oval-shaped, and combinations thereof.

In Example 39, the subject matter of any one or more of Examples 22-38 optionally include wherein the cosmetic applicator comprises a stem coupled to the distal end of the handle body and a tip coupled to a distal end of the stem, and wherein the tip is selected from the group consisting of a brush, comb, felt, foam, flocked surfaces, and combinations thereof.

In Example 40, the subject matter of any one or more of Examples 22-39 optionally include wherein the elevated feature material is a material selected from a group consisting of thermoplastic elastomers, silicon rubber, thermoplastic rubber, thermoplastic olefins, and combinations thereof.

Example 41 is a cosmetic applicator assembly, comprising: a handle body comprising a proximal end, a distal end, a largest width or diameter of from 0.4 inches to 1.25 inches, and an exterior surface extending from the proximal end to the distal end, wherein the handle body comprises a handle body material, wherein at least a portion of a length of the handle body comprises a receiving portion that has a width or diameter that is less that the largest width or diameter; a sleeve mateable with the receiving portion, the sleeve having a minimum thickness that is the difference between the largest width or diameter and the reduced width or diameter of the handle body, wherein: the sleeve comprises a sleeve material, the sleeve material has an optical transmittance of at least 65%; the sleeve material has a kinetic coefficient of friction of from 2.0 to 6.0 and a hardness of less than or equal to Shore A 70, and the sleeve material has a hardness that is less than the hardness of the handle body material; and a cosmetic applicator coupled to the distal end of the handle body.

In Example 42, the subject matter of Example 41 optionally includes a decorative layer disposed between the handle body and the sleeve.

In Example 43, the subject matter of any one or more of Examples 41-42 optionally include wherein the sleeve has an elevated feature disposed along at least a portion of an exterior surface of the sleeve that extends from 0.007 inches to 0.020 inches above the exterior surface of the sleeve.

In Example 44, the subject matter of any one or more of Examples 41-43 optionally include wherein the kinetic coefficient of friction of the sleeve material is from 3.5 to 6.0 and the hardness of the elevated feature material is from Shore A 40 to Shore A 60.

In Example 45, the subject matter of any one or more of Examples 41-44 optionally include a ratio of the surface area of the exterior surface of the sleeve covered by the elevated feature to the total surface area of the exterior surface of the sleeve that ranges from 10% to 93%.

In Example 46, the subject matter of Example 45 optionally includes wherein the elevated feature comprises a plurality of elevated features spaced apart from each other along the exterior surface of the sleeve.

In Example 47, the subject matter of Example 46 optionally includes wherein the sleeve has a surface roughness from 0.370 to about 0.580.

In Example 48, the subject matter of any one or more of Examples 46-47 optionally include wherein the plurality of elevated features forms a dot pattern and the ratio is from 13% to 40%.

In Example 49, the subject matter of any one or more of Examples 46-48 optionally include wherein the plurality of elevated features forms a wavy pattern and the ratio is from 10% to 33%.

In Example 50, the subject matter of any one or more of Examples 46-49 optionally include wherein the plurality of elevated features forms a cross-hatched pattern and the ratio is from 30% to 93%.

In Example 51, the subject matter of any one or more of Examples 46-50 optionally include wherein the plurality of elevated features form a plurality of gripping zones, each one of the plurality of gripping zones comprising a portion of the plurality of elevated features and having a minimum area of 1.15 square inches.

In Example 52, the subject matter of Example 51 optionally includes wherein the plurality of gripping zones comprises three gripping zones.

In Example 53, the subject matter of Example 52 optionally includes wherein the three gripping zones are disposed about the handle body substantially equidistant from each other.

In Example 54, the subject matter of any one or more of Examples 51-53 optionally include wherein each one of the plurality of gripping zones is not integral with another one of the plurality of gripping zones.

In Example 55, the subject matter of any one or more of Examples 41-54 optionally include wherein a radial cross sectional shape of the handle body is selected from the group consisting of circular-shaped, oval-shaped, triangular-shaped, quadrilateral-shaped, pentagonal-shaped, hexagonal-shaped, heptagonal-shaped, octagonal-shaped, nonagonal-shaped, decagonal-shaped, and combinations thereof.

In Example 56, the subject matter of any one or more of Examples 41-55 optionally include wherein a longitudinal cross sectional shape of the handle body is selected from the group consisting of linear-shaped, nonlinear-shaped, cigar-shaped, quadrilateral-shaped, oval-shaped, and combinations thereof.

In Example 57, the subject matter of any one or more of Examples 41-56 optionally include wherein the cosmetic applicator comprises a stem coupled to the distal end of the handle body and a tip coupled to a distal end of the stem, and wherein the tip is selected from the group consisting of a brush, comb, felt, foam, flocked surfaces, and combinations thereof.

In Example 58, the subject matter of any one or more of Examples 41-57 optionally include wherein the sleeve material is a material selected from a group consisting of thermoplastic elastomers, silicon rubber, thermoplastic rubber, thermoplastic olefins, and combinations thereof.

It should be understood that any feature and/or element of any one of the embodiments and/or examples shown and described above herein may be removed from the embodiment and/or example, replaced with a feature or element from another embodiment or example herein or replaced with an equivalent feature or element.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any embodiment disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present disclosure have been illustrated and described, it would be obvious to those skilled in the art that various other changes and modifications can be made. It is therefore intended to cover in the appended claims all such changes and modifications.

The invention claimed is:

1. A cosmetic applicator assembly, comprising:

a handle body comprising a proximal end, a distal end, a largest width or diameter of from 0.4 inches to 1.25 inches, and an exterior surface extending from the proximal end to the distal end, wherein the handle body comprises a handle body material;

an elevated feature disposed along at least a portion of the exterior surface and extending from 0.007 inches to 0.020 inches above the exterior surface, wherein:

the elevated feature comprises an elevated feature material, the elevated feature material has a kinetic coefficient of friction of from 2.0 to 6.0 and a hardness of less than or equal to Shore A 70, and the elevated feature material has a hardness that is less than the hardness of the handle body material; and a cosmetic applicator coupled to the distal end of the handle body.

2. The cosmetic applicator assembly of claim 1, wherein the kinetic coefficient of friction of the elevated feature material is from 3.5 to 6.0 and the hardness of the elevated feature material is from Shore A 40 to Shore A 60.

3. The cosmetic applicator assembly of claim 1, further comprising a ratio of a surface area of the exterior surface covered by the elevated feature to a total surface area of the exterior surface that ranges from 10% to 93%.

4. The cosmetic applicator assembly of claim 1, wherein the elevated feature comprises a plurality of the elevated features spaced apart from each other along the exterior surface.

5. The cosmetic applicator assembly of claim 4, wherein the plurality of elevated features forms a dot pattern and the ratio is from 13% to 40%.

6. The cosmetic applicator assembly of claim 4, wherein the plurality of elevated features forms a wavy pattern and the ratio is from 10% to 33%.

7. The cosmetic applicator assembly of claim 4, wherein the plurality of elevated features forms a cross-hatched pattern and the ratio is from 30% to 93%.

8. The cosmetic applicator assembly of claim 4, wherein the plurality of elevated features form a plurality of gripping zones, each one of the plurality of gripping zones comprising a portion of the plurality of elevated features and having a minimum area of 1.15 square inches.

9. The cosmetic applicator assembly of claim 8, wherein the plurality of gripping zones comprises three gripping zones.

10. The cosmetic applicator assembly of claim 9, wherein the three gripping zones are disposed about the handle body substantially equidistant from each other.

11. The cosmetic applicator assembly of claim 8, wherein each one of the plurality of gripping zones is not integral with another one of the plurality of gripping zones.

12. The cosmetic applicator assembly of claim 1, wherein a radial cross sectional shape of the handle body is selected from the group consisting of circular-shaped, oval-shaped, triangular-shaped, quadrilateral-shaped, pentagonal-shaped, hexagonal-shaped, heptagonal-shaped, octagonal-shaped, nonagonal-shaped, decagonal-shaped, and combinations thereof.

13. The cosmetic applicator assembly of claim 1, wherein a longitudinal cross sectional shape of the handle body is selected from the group consisting of linear-shaped, nonlinear-shaped, cigar-shaped, quadrilateral-shaped, oval-shaped, and combinations thereof.

14. The cosmetic applicator assembly of claim 1, wherein the cosmetic applicator comprises a stem coupled to the distal end of the handle body and a tip coupled to a distal end of the stem, and wherein the tip is selected from the group consisting of a brush, comb, felt, foam, flocked surfaces, and combinations thereof.

15. The cosmetic applicator assembly of claim 1, wherein the elevated feature material is a material selected from a group consisting of thermoplastic elastomers, silicon rubber, thermoplastic rubber, thermoplastic olefins, and combinations thereof.

16. A cosmetic applicator assembly, the applicator assembly comprising:

a handle body comprising a proximal end, a distal end, a largest width or diameter of from 0.4 inches to 1.25 inches, and an exterior surface, wherein the handle body is comprised of a handle body material;

an elevated feature disposed along the handle body comprising an elevated feature material having a kinetic coefficient of friction of from 2.0 to 6.0 and a hardness of less than or equal to Shore A 70;

a sleeve disposed along at least a portion of the exterior surface, the sleeve comprising a foam material; and a cosmetic applicator coupled to the distal end of the handle body and constructed to apply a cosmetic.

17. The cosmetic applicator assembly of claim 16, wherein the foam material comprises polyurethane (PU), hydrophilic polyurethane, polyester, and combinations thereof.

18. The cosmetic applicator assembly of claim 17, wherein the foam material has a porosity of from about 60 to about 115 pores per square inch.

19. The cosmetic application assembly of claim 16, wherein the foam material comprises at least one of a shape memory foam and a closed cell foam.

20. A cosmetic applicator assembly, comprising:

a handle body comprising a proximal end, a distal end, a largest width or diameter of from 0.4 inches to 1.25 inches, and an exterior surface extending from the proximal end to the distal end, wherein the handle body comprises a handle body material;

an elevated feature disposed along at least a portion of the exterior surface and extending from 0.007 inches to 0.020 inches above the exterior surface, wherein:

the elevated feature comprises an elevated feature material, the elevated feature material has a kinetic coefficient of friction of from 2.0 to 6.0 and a hardness of less than or equal to Shore A 70, and the elevated feature material has a hardness that is less than the hardness of the handle body material; and a cosmetic applicator coupled to the distal end of the handle body, wherein the elevated feature comprises a plurality of the elevated features spaced apart from each other along the exterior surface and a surface of the exterior surface covered by the elevated feature has a surface roughness from 0.370 to about 0.580.

* * * * *